United States Patent [19]

MacLeod et al.

[11] Patent Number: 5,009,149

[45] Date of Patent: Apr. 23, 1991

[54] ROOF VENT

[75] Inventors: Richard J. MacLeod, Milford; Norman L. Chubb, Dearborn; Charles E. Schiedegger, Metamora, all of Mich.

[73] Assignee: Tapco Products Company, Inc., Detroit, Mich.

[21] Appl. No.: 452,239

[22] Filed: Dec. 18, 1989

Related U.S. Application Data

[63] Continuation-in-part of Ser. No. 293,946, Jan. 5, 1989, Pat. No. 4,924,761.

[51] Int. Cl.[5] ..... F24F 7/02

[52] U.S. Cl. ..... 98/42.21

[58] Field of Search ..... 52/57, 199; 98/42.01, 98/42.21, 42.22, 121.1

[56] References Cited

U.S. PATENT DOCUMENTS

| | | | |
|---|---|---|---|
| 1,785,682 | 12/1930 | Hamilton | 98/121.1 X |
| 1,896,656 | 2/1933 | Anderson | 98/121.1 X |
| 3,236,170 | 2/1966 | Meyer et al. | 98/42.21 |
| 3,481,263 | 12/1969 | Belden | 98/42.21 |
| 3,660,955 | 5/1972 | Simon | 98/42.21 X |
| 3,694,982 | 10/1972 | Gerhaher | 52/57 X |
| 4,280,399 | 7/1981 | Cunning | 98/42.21 |
| 4,325,290 | 4/1982 | Wolfery | 98/42.21 |
| 4,545,291 | 10/1984 | Kutsch et al. | 98/42.21 |
| 4,642,958 | 2/1987 | Pewitt | 98/42.21 X |
| 4,643,680 | 2/1987 | Trostle et al. | 98/42.21 |
| 4,817,506 | 4/1989 | Cashman | 98/42.21 |
| 4,907,499 | 3/1990 | James | 98/42.21 |

FOREIGN PATENT DOCUMENTS

| | | | |
|---|---|---|---|
| 3320850 | 12/1984 | Fed. Rep. of Germany | 52/199 |
| 3615015 | 12/1987 | Fed. Rep. of Germany | 98/42.21 |

*Primary Examiner*—Harold Joyce

*Attorney, Agent, or Firm*—Barnes, Kisselle, Raisch, Chaote, Whittemore & Hulbert

[57] ABSTRACT

A roof vent comprising a one piece plastic body including a base wall having transversely spaced rows of integral vanes extending from one surface thereof. The vanes of adjacent rows are positioned such that the vanes define a sinuous path. Preferably, one of each of the rows has the wings extending at an acute angle to the axis of the wall and the other row of each set of rows has the wings extending at an oppositely directed acute axis to the longitudinal axis of the wall toward the wings of the one row. Thus air is vented through sinuous paths outwardly when the vent is positioned with the wings engaging the roof and the base wall spaced from the roof. Water and snow are prevented by the wings from entry beneath the vent into the building.

11 Claims, 7 Drawing Sheets

ROOF VENT

This application is a continuation in part of Ser. No. 293,946 filed Jan. 5, 1989, now issued as U.S. Pat. No. 4,924,761.

This invention relates to roof vents.

BACKGROUND AND SUMMARY OF THE INVENTION

It has heretofore been known that it is desirable to provide means for ventilating a roof. Typical patents that have been heretofore suggested are, for example, 2,799,214, 3,236,170, 3,949,657, 4,280,399, 4,325,290, 4,554,862, 4,642,958, 4,643,080 and 4,817,506.

Among the objectives of the present invention are to provide an improved roof vent which will effectively vent the interior of a building; which will preclude entry of water and blowing snow and insects by the action of wind from entering the building; which will prevent insects and the like from entering the building; which can be readily adapted to roofs of varying slopes and inclinations; which will prevent ice build-up thereon; which is pleasing in appearance; which is low cost; and which can be readily handled in the field; and which can be utilized for arrangement of roofs which are unsymmetrical.

In accordance with the invention, a roof vent comprising a one piece plastic body including a base wall having transversely spaced rows of integral vanes extending from one surface thereof. The vanes of adjacent rows are positioned such that the vanes define a sinuous path. Preferably, one of each of said rows having the wings extending at an acute angle to the axis of the wall and the other row of each set of rows has the wings extending at an oppositely directed acute axis to the longitudinal axis of the wall toward the wings of the one row. Thus air is vented through sinuous paths outwardly when the vent is positioned with the wings engaging the roof and the base wall spaced from the roof. Water and snow are prevented by the wings from entry beneath the vent into the building.

In another form, the plastic body is constructed and arranged to accommodate roofs with different slopes while at the same time providing and aesthetic appearance.

DESCRIPTION

Figure 1:
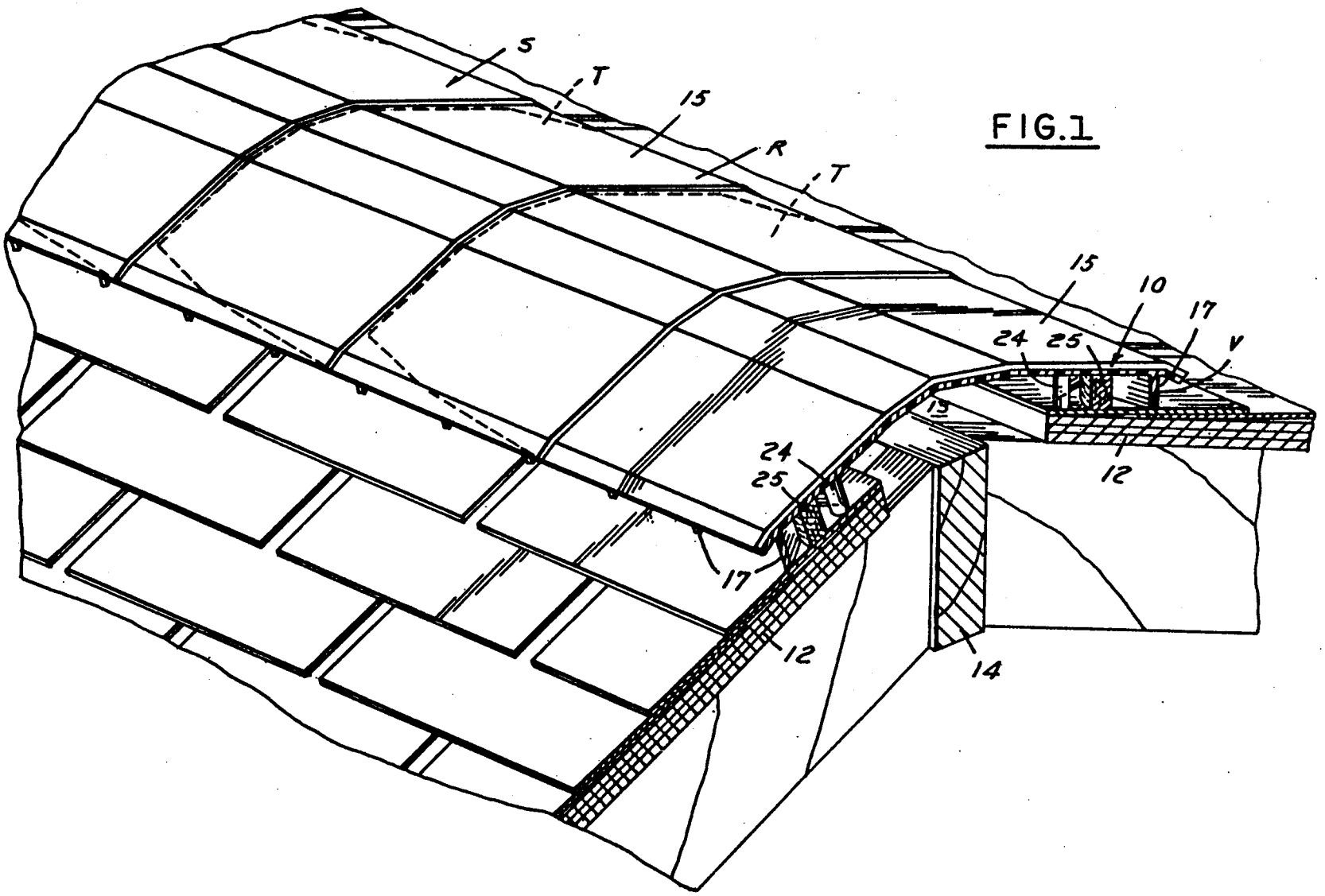
FIG. 1 is fragmentary part sectional view of a building utilizing the roof vent embodying the invention.
Figure 2:
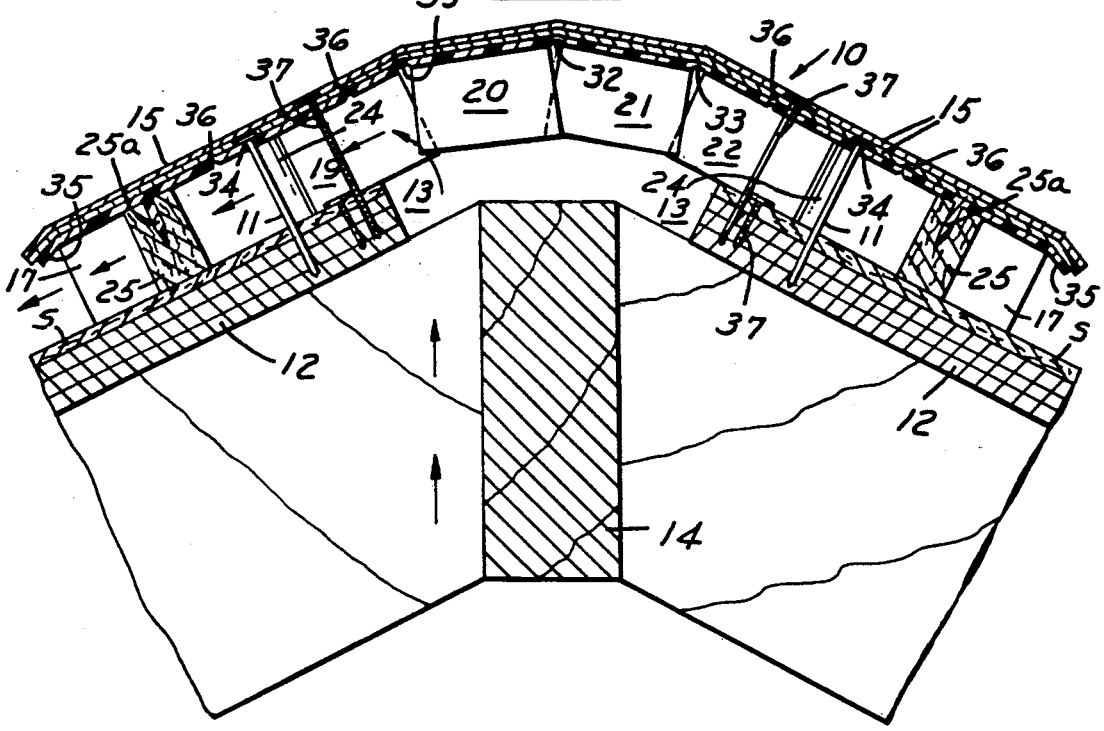
FIG. 2 is a transverse section through a roof of a building utilizing the roof vent embodying the invention.

Referring to FIGS. 1 and 2 the roof vent 10 embodying the invention is adapted to be mounted on the ridge of a roof by nails 11 extending into the roof in order that the interior of the building may be vented. In accordance with well known construction, portions of the roof walls 12 are cut away as at 13 adjacent the ridge board 14 and the vent 10 is positioned over the shingles on the roof walls 12 and over the opening 13. Subsequently, sections of roofing or shingle material 15 are provided over the vent in overlapping relation, if desired over the roof vent.

Figure 5:
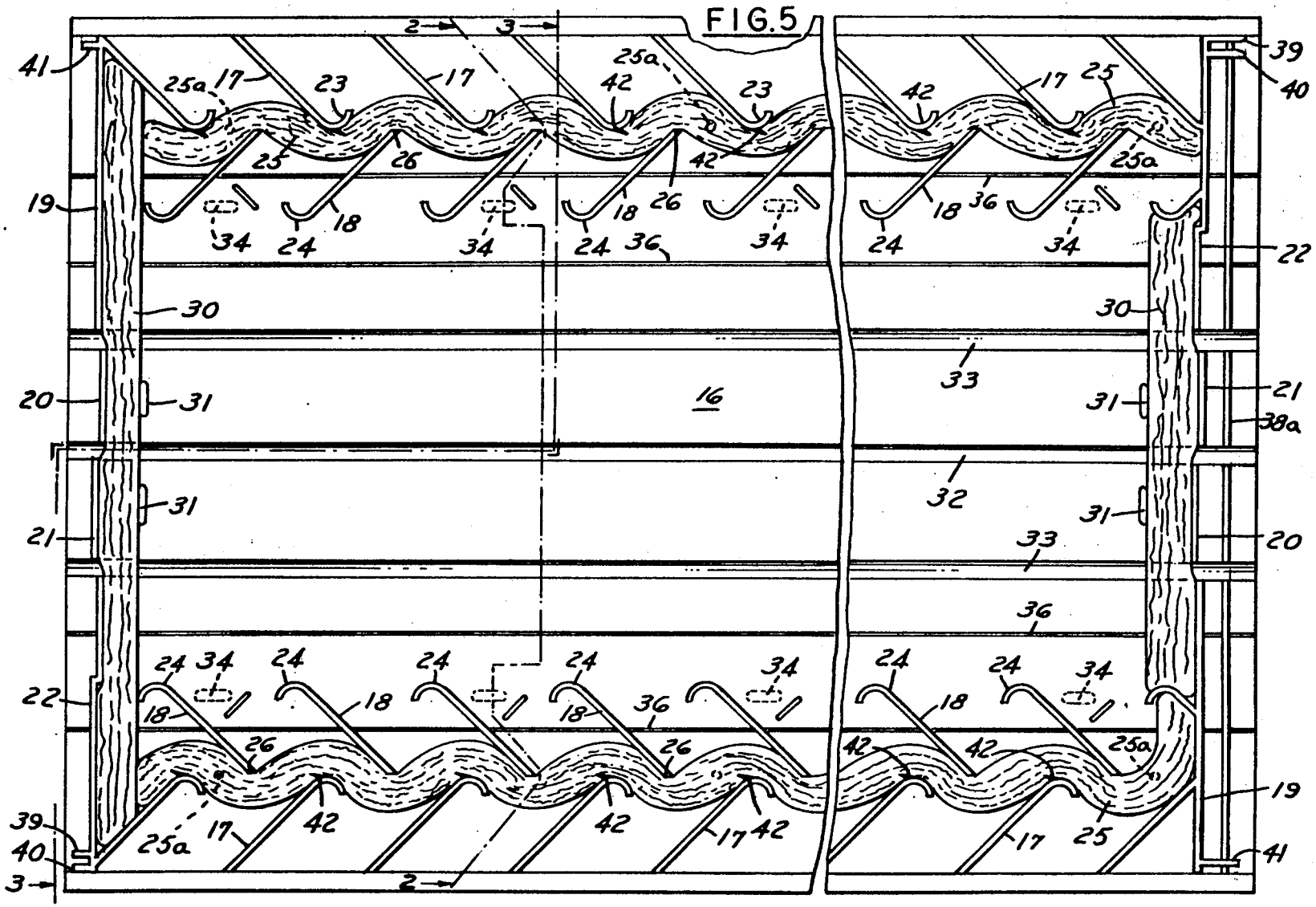
FIG. 5 is a bottom plan of the roof vent embodying the invention before it is bent to conform to the roof.

In accordance with the invention, the roof vent 10 comprises a one piece plastic body which is molded preferably by injection molding and includes a base wall 16 from which a plurality of rows of wings 17, 18 extend in generally perpendicular fashion from the wall 16. In addition the roof vent includes end walls 19, 20, 21, 22 that are molded integrally with the base wall 16 and extend outwardly in relatively longitudinally spaced relation for purposes presently described. Each set of the wings 17, 18 is provided in two rows along the longitudinal edges of the base wall 16 (FIG. 5), the wings 17, 18 being identical except that the row of wings 17 in the outermost row are in longitudinally spaced parallel relation and the wings 18 in the innermost row are in longitudinally spaced relation such that the plane of the wings 17 intersects the plane of the wings 18. In addition, each of the wings 17 is provided with a curved end 23 as are the wings 18 provided with a curved end 24. The curved ends 23, 24 function to entrap water and snow that may be blown inwardly by wind.

Further, a layer 25 of foraminous material such as open cell foam plastic is interposed between the adjacent ends 23 and 26 of the wings 17, 18 and functions to prevent insects from entering the building while permitting air to exit from under the roof. Preferably, the layers 25 are held in position by integral pins 25*a* that extend from inner surface of the base wall 16.

Similarly, a layer 30 of nonporous plastic material is provided adjacent each end of the walls 19–22 and is held in position by projections 31 that extend from the surface of the wall to prevent the entry of insects as well as air and moisture through the end walls.

Figure 7:
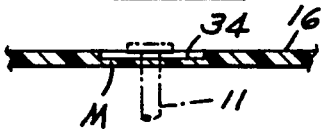
FIG. 7 is a sectional view through a portion of the roof vent as fastened to a roof.

The base wall 16 is formed with portions 32, 33 that extend longitudinally and have a thinner cross section so that the user can bend the wall to the desired angle for conforming the roof vent to the angle of the roof members 12. After such a conformation, the nails 11 can be driven through openings 34 to mount the vent in position on the roof. As shown in FIG. 7, a membrane M of thinner cross section closes the elongated openings 34 such that only a portion of the elongated opening will be pierced by the nail 11 thus minimizing any chance of moisture or rain from entering through the openings that are formed by the piercing. Walls 50 are provided against each opening 34 opposite each wing 18. When a nail 11 is driven, the wing 18 and adjacent wall 50 cooperate to absorb the force of the hammer on the base wall 16 preventing deformation of the back wall 16 as might occur if the portion were not supported. Thus, the pleasing appearance of the roof vent is facilitated.

It can be seen that the periphery of the vent adjacent the shingles is designed such that moisture, snow and rain cannot collect to cause ice build-up.

The edges 35 of the wall are a slight angle to the plan of the wall such that they form an overhang as that shown in FIG. 1. When the base wall 16 is bent along the lines 32, 33, the end walls 20, 21 are caused to overlap one another as viewed in FIG. 1, as shown in the broken lines to close and form a continuous wall.

Figure 6:
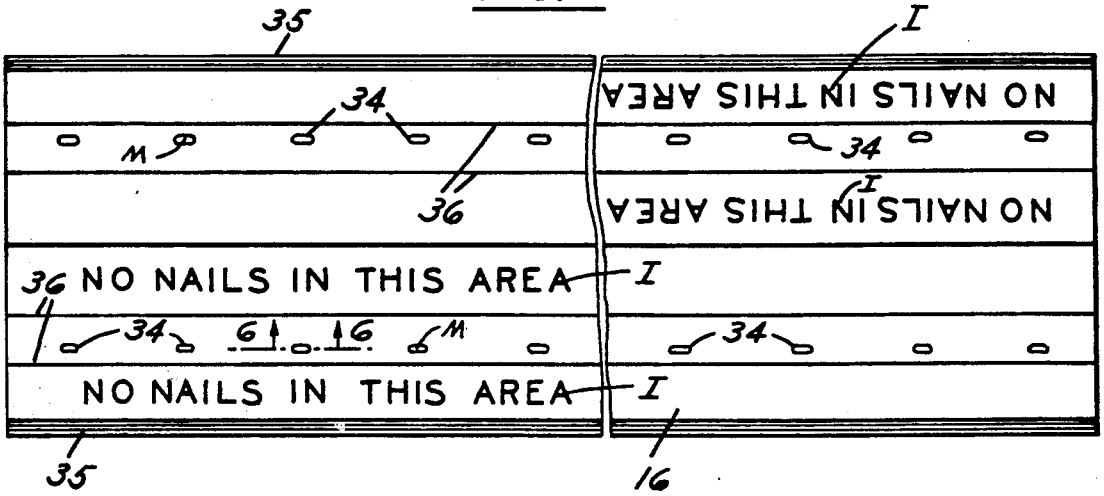
FIG. 6 is fragmentary bottom plan view on a reduce scale of the roof vent shown in FIGS. 3 and 5.

A guide line in the form of an integral ridge 36 is provided along the inner surface of the wall 16 to serve as a visual indicator to the roofer so that the nails 11 for fastening the roofing 15 are provided inwardly of the rows of wings 17, 18. Preferably as shown in FIG. 6, indicia I in the form of lettering is provided in the areas so that a workmen will not nail through these areas.

Figure 4:
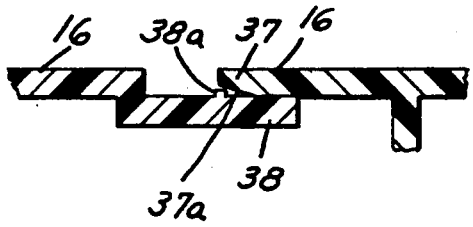
FIG. 4 is a fragmentary view showing the overlapping of adjacent roof vents along a roof.

As adjacent lengths of roof vent are applied to a roof, the ends of the base wall 16 are molded such that opposite ends overlap as at 37, 38 (FIG. 4). In order to provide sufficient space for normal longitudinal expansion and contraction due to temperature changes, aligning ridge 38*a* is provided on base wall 16 and the portion 37 is formed with a bevelled surface 37*a*. The workman utilizes the aligning ridge 38*a* for initial positioning of the adjacent roof vents and the bevel will permit longitudinal movement of the roof vents relative to one another as may occur during expansion and contraction due to temperature variations. In addition, the end walls 19, 22 are provided with spaced longitudinally extending walls portions 39, 40 that cooperate with a portion 41 on the wall 19 to telescope within portions 39, 40 and interfit the ends of one roof vent with respect to the other.

In order to hold the material 25 in position, the wings 17, 18 may also be provided with projections 42 that tend to engage and hold the material in position.

Figure 3:
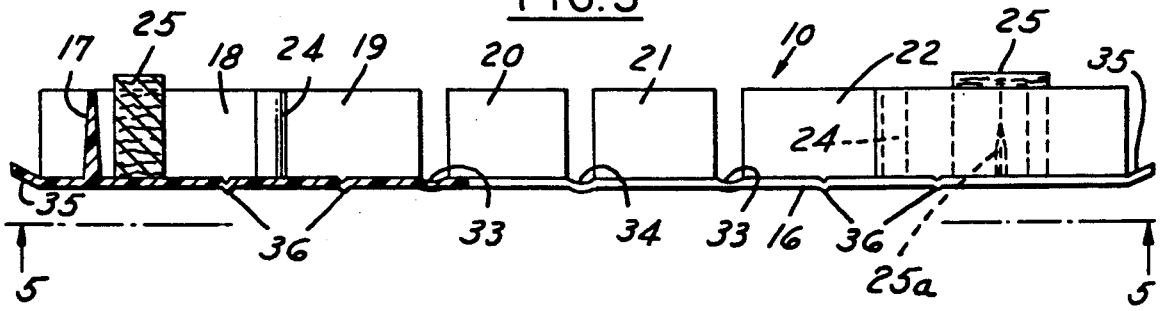
FIG. 3 is a sectional view taken along the line 3—3 in FIG. 5.

As shown in FIG. 3, the height of the layers 25, 30 is greater than the height of the wings 17, 18 and end walls 192 22 such that when the vent is nailed into position, the layers 25, 30 become compressed to seal against the shingles and fill any underlying slots in the shingles.

Figure 8:
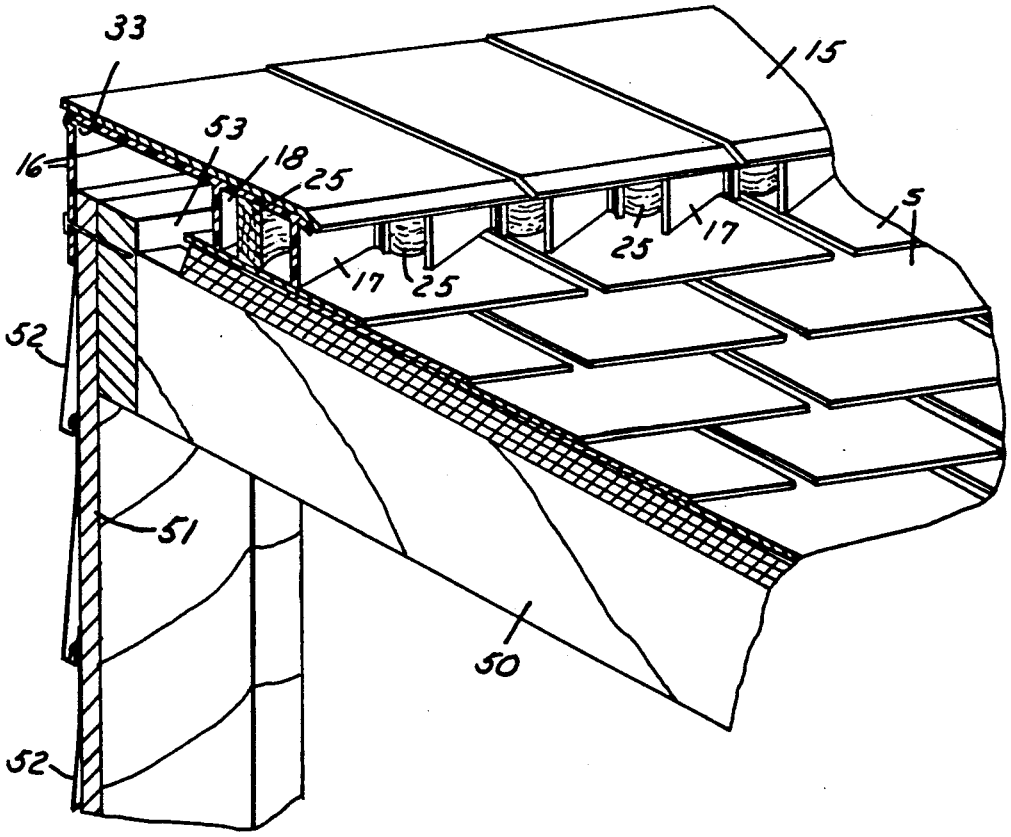
FIG. 8 is fragmentary sectional perspective view showing the adaptation of the roof vent to a different roof.

Although the roof vent embodying the invention is partially intended for use in connection with roofs that have inclined roof walls 12 as shown in FIGS. 1 and 2, it can readily adapted to other roof arrangements by severing a portion of the roof vent along a line 33 by a hand knife. Thus as shown in FIG. 8 such a partial roof vent can be adapted to a roof having an inclined wall 50 that extends from a vertical wall 51 that has siding 52 thereon. In such an arrangement, the roof vent from which part of the base wall and two rows of the wings have been severed is positioned with the remaining rows of the roof vent and base wall overlying the opening 53 which is to be vented with base wall 16 folded about the remaining bend line 33 to extend in overlapping relation to the uppermost siding 52. The roof vent is nailed in the same fashion over the shingles S of the wall 50, and if desired shingle sections 15 can be provided over the roof vent.

Figure 9:
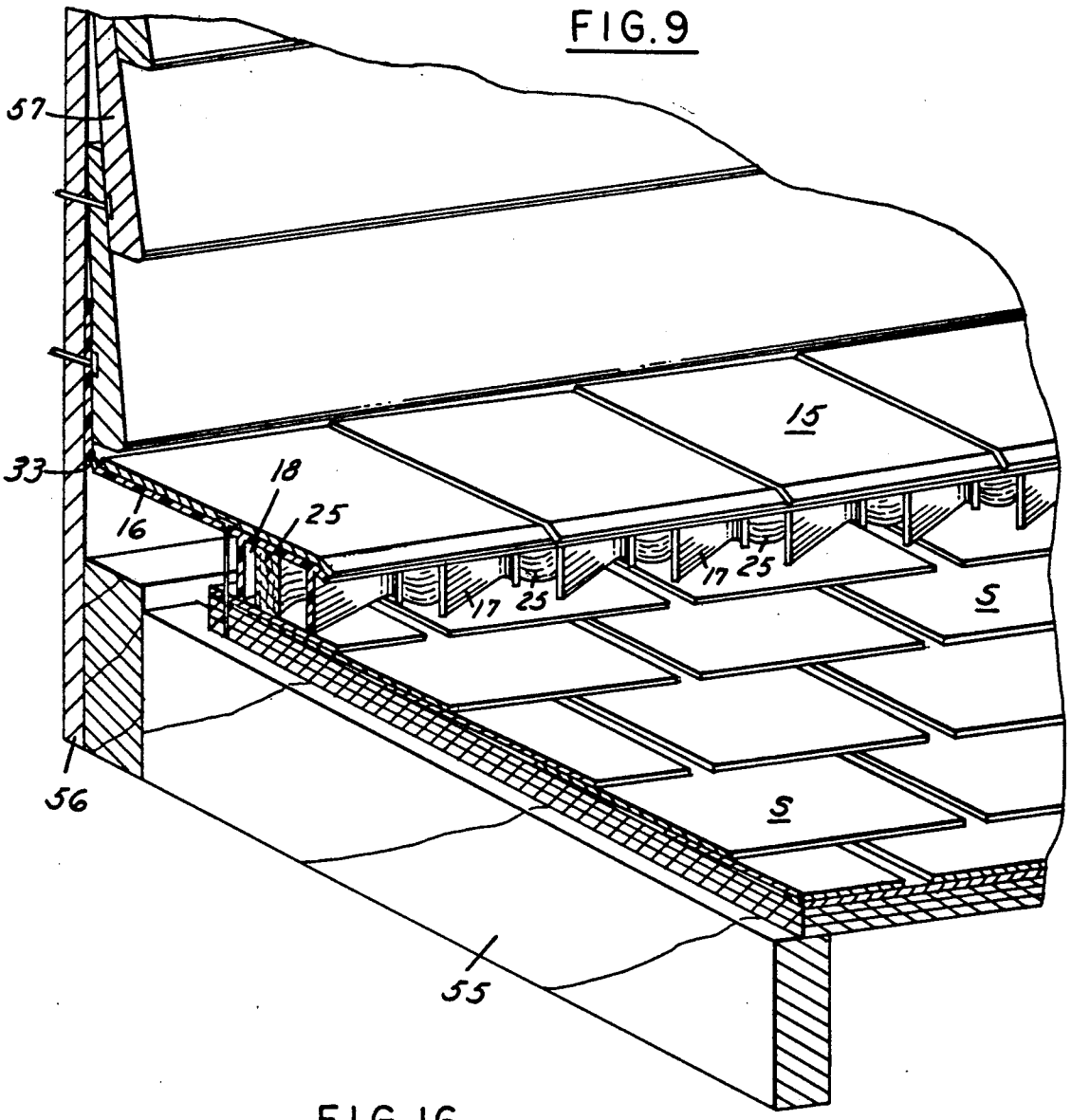
FIG. 9 is fragmentary sectional perspective view showing the adaptation of the roof vent to another roof.

The partial roof vent can also be utilized in an arrangement such as shown in FIG. 9 wherein the roof 55 is inclined and intersects a wall 56 that extends vertically above the roof and has siding 57 thereon. As in the form shown in FIG. 8 the remaining rows of wings contact the shingles S and wall 16 is bent along the line 33 to extend along the vertical wall 56 of the building.

Figure 10:
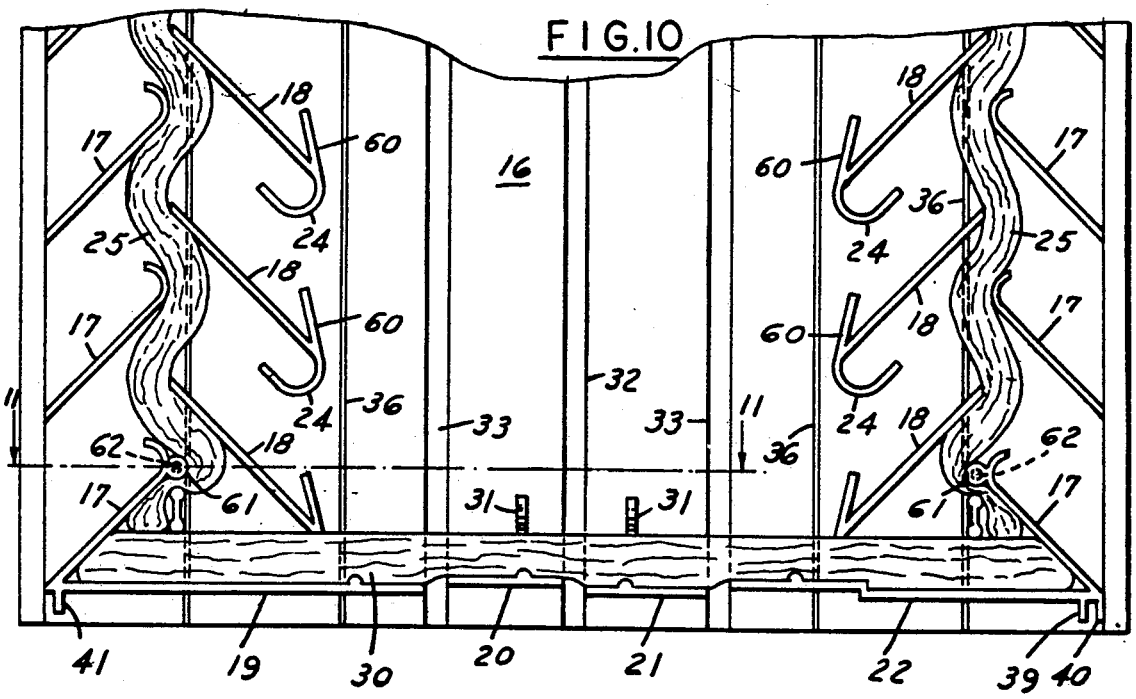
FIG. 10 is a fragmentary plan view of a modified roof vent.
Figure 11:
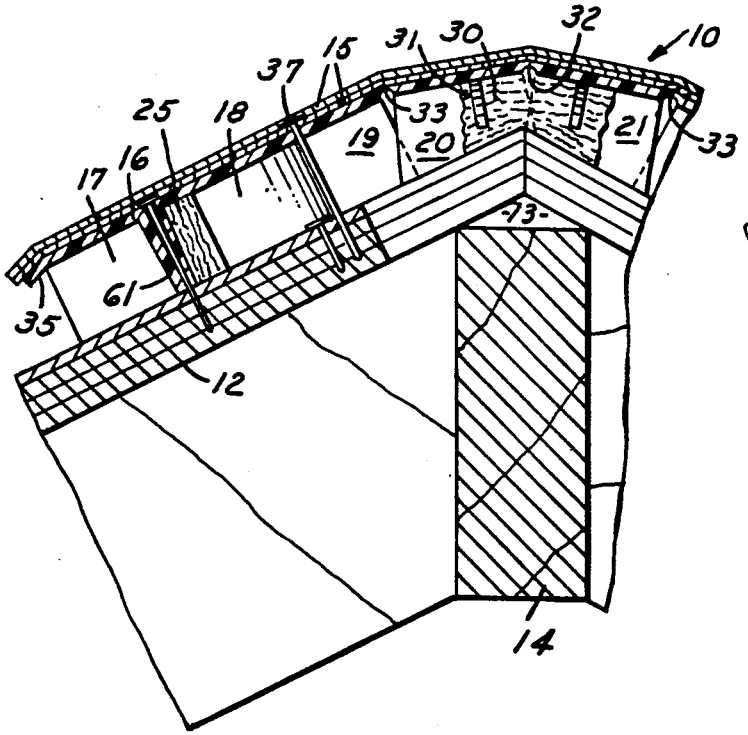
FIG. 11 is a fragmentary sectional view taken along the line 11 in FIG. 10.
Figure 12:
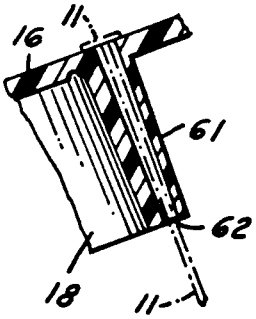
FIG. 12 is a fragmentary sectional view on an enlarged scale of a portion of the roof vent shown in FIG. 11.

In the modified form of roof vent shown in FIGS. 10–12, the wings 18 are longer than arrays 17 and are provided with generally axially extending straight portions 60 which are tangent to the curved portions 24 and extend longitudinally of the roof vent to provide deflection of moisture and the like and inhibit passage thereof through the roof vent to the interior.

The portions 60 preferably extend at an acute angle to the longitudinal axis of the roof vent which is less than the acute angle between the portions 60 and a transverse axis at a right angle to the longitudinal axis.

The distance between the free end of each portion 60 and the adjacent curved portion 24 is substantially equal to the distance between each vane 18 and the return straight portion 24*a* of each curved portion 24 in order that there is minimal pressure drop in the flow of air through the roof vent. In addition, tubular projections 61 are provided on the inner ends of the vane 17 and have there lower ends closed by a membrane 62. The projection 61 provide guides for the nails 11 and further provide support so when the nails are driven into the roof 12, the extent of a passage of the nails is limited by the height of the tubular portions 61, which is the same as that of the walls 19.

Figure 13:
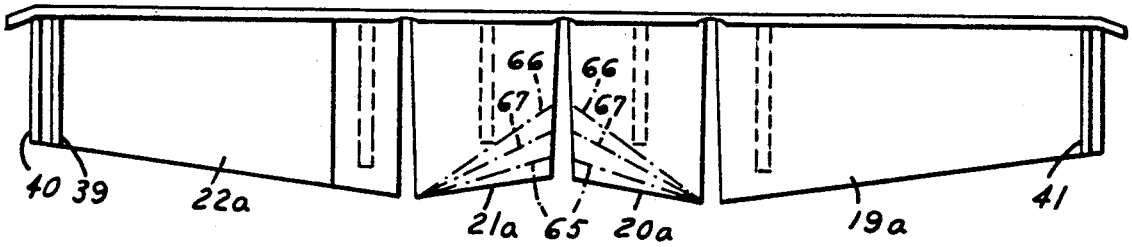
FIG. 13 is an end view of a further modified form of roof vent.
Figure 14:
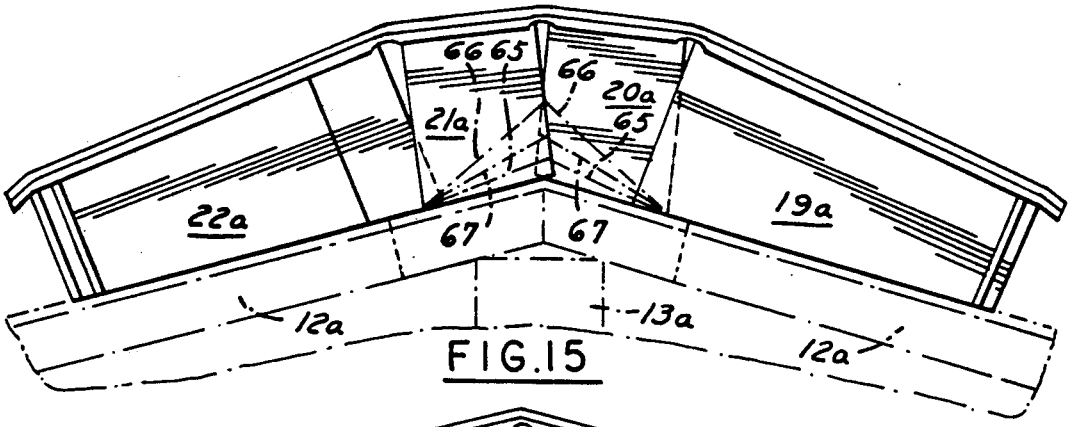
FIG. 14 is a partly diagrammatic view of the roof vent shown in FIG. 13 on a roof having a predetermined slope.
Figure 15:
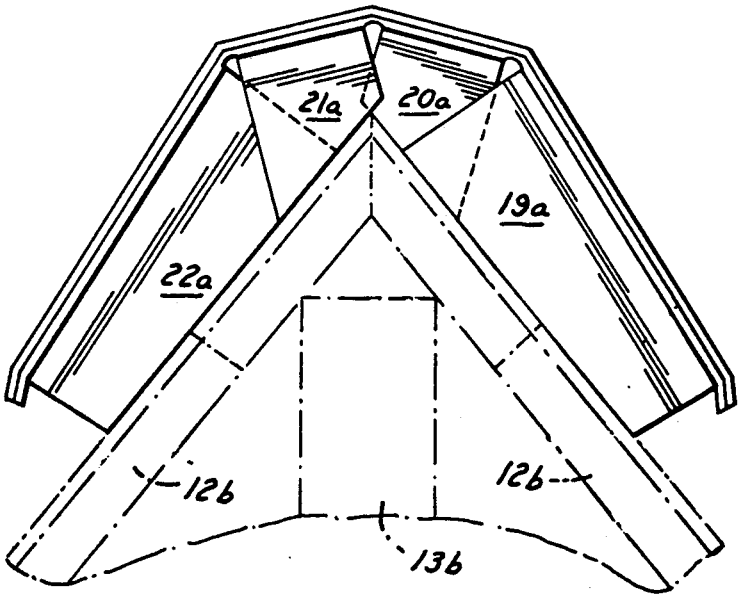
FIG. 15 is a view similar to FIG. 14 showing the roof vent applied to a roof having a greater slope.

In the form shown in FIGS. 13–15, the lower edges of the walls 19*a*, 22*a* are tapered so that the height of the walls 19*a*, 22*a* increases progressively toward the interior. The walls 20*a*, 21*a* have there lower edges tapered so that the height progressively decreases toward the center of the roof vent. In addition, each of the walls 20*a*, 21*a* is provided with scribe lines 65, 66, 67 along which a portion of the lower edge can be broken or cut away so that the roof vent can be used of roofs of different slopes as shown in FIGS. 14 and 15 respectively.

By this construction, a more flat appearance is provided so that the viewer views more of the top wall and less of the vanes, especially when the roof has a steep slope.

Figure 16:
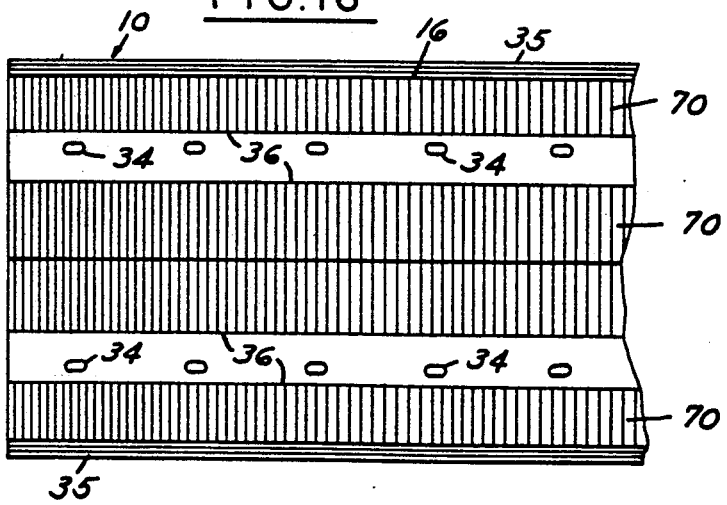
FIG. 16 is a fragmentary plan view of a modified form of roof vent.

In the form of the invention shown is FIG. 16, the roof vent 10 includes indicia in the form of a plurality of transverse ribs 70 which facilitate the workman in positioning the roofing material so that its edges are at a right angle to the axis of the roof vent. The ribs 70 are interrupted at the nailing areas.

It can thus be seen that there has been provided a roof vent which will effectively vent the interior of a building; which will preclude entry of water and blowing snow and insects, by the action of wind from entering the building; which will prevent ice build-up thereon; which can be readily adapted to roofs of varying slopes and inclinations; which is pleasing in appearance; which is low cost; and which can be readily handled in the field; and which can be utilized for arrangement of roofs which are unsymmetrical.

We claim:

1. A roof vent comprising a one-piece plastic body including a base wall having transversely spaced sets of rows of integral vanes extending from one surface thereof, each vane having a free end adapted to engage the roof when the vent is in position on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, and tubular projections on each vane forming nail openings, said projections being formed with integral membranes closing the openings therein.

2. A roof vent comprising a one-piece plastic body including a base wall having transversely spaced sets of rows of integral vanes extending from one surface thereof, each vane having a free end adapted to engage the roof when the vent is in position on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, and a portion extending from each vane at the juncture of said vane and the curved portion of said vane longitudinally of said roof vent in a direction away from said curved portion, said portion extending at an acute angle to the axis of the longitudinal axis of the roof vent which is less than the acute angle of the portion with a transverse axis of the vane.

3. The roof vent set forth in claim 2 wherein the distance between the free end of each portion and the adjacent curved portion is substantially equal to the return straight portion of each curved portion.

4. A roof vent comprising a one-piece plastic body including a base wall having transversely spaced sets of rows of integral vanes extending from one surface thereof, each vane having a free end adapted to engage the roof when the vent is in position on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, end walls integral with said base wall, said end walls overlapping one another when the base wall of the roof vent is bent and applied to a roof, said vanes and said portions of said end walls adjacent said vanes having free edges which are inclined at an acute angle to the base wall such that the base wall is inclined with respect to the free edges, said remaining end walls are provided with indicia at various angles to the base wall such that portions of said remaining end walls can be severed to conform the roof vent with ridges of different slopes.

5. A roof vent comprising a one-piece plastic body including a base wall having at least one set of transversely spaced sets of rows of integral vanes extending from one surface thereof, each vane having a free end adapted to engage the roof when the vent is positioned on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, said vanes being generally planar, and tubular projections on each vane forming nail openings, said projections being formed with integral membranes closing the openings therein.

6. The roof vent set forth in claim 5 wherein the portion extends at an acute angle to the axis of the longitudinal axis of the roof vent which is less than the acute angle of the portion with a transverse axis of the vane.

7. The roof vent set forth in claim 6 wherein the distance between the free end of each portion and the adjacent curved portion is substantially equal to the return straight portion of each curved portion.

8. A roof vent comprising a one-piece plastic body including a base wall having at least one set of transversely spaced sets of rows of integral vanes extending from one surface thereof, each vane having a free end adapted to engage the roof when the vent is positioned on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, said vanes being generally planar, end walls integral with said base wall, said end walls overlapping one another when the base wall of the roof vent is bent and applied to a roof, said vanes and said portions of said end walls adjacent said vanes have free edges which are inclined at an acute angle to the base wall such that the base wall is inclined with respect to the free edges, said remaining end walls are provided with indicia at various angles to the base wall such that portions of said remaining end walls can be severed to conform the roof vent with ridges of different slopes.

9. A roof vent comprising a one-piece plastic body including a base wall having transversely spaced sets of rows of integral vanes extending from one surface thereof, each vane having a free end adapted to engage the roof when the vent is in position on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer, said plastic body having end walls integral with said base wall, said end walls overlapping one another when the base wall of the roof vent is bent and applied to a roof, said vanes and said end walls having free edges which are adapted to engage the roof, said free edges of said end walls adjacent each set of vanes being tapered so that the height of said walls increases progressively toward the interior, said free edges of said end walls between said sets of vanes being tapered so that the height of said walls decreases progressively toward the longitudinal center of the roof vent such that a viewer views more of the base wall and less of the vanes.

10. The roof vent set forth in claim 9 wherein said end walls between said sets of vanes are provided with indicia at various angles to the base wall such that portions thereof can be served to conform the roof vent with ridges of different slopes.

11. A roof vent comprising a one-piece plastic body including a base wall having a plurality of integral vanes extending from one surface thereof along the length of the base wall, each vane having a free end adapted to engage the roof when the vent is in position on a roof, the vanes being longitudinally spaced from one another, and having portions extending at an acute angle to the axis of the wall, tubular projections on at least some of said vanes forming nail openings, said tubular projections extending for substantially the full height of the respective vanes.

* * * * *